US006170213B1

(12) United States Patent
Zarrelli et al.

(10) Patent No.: US 6,170,213 B1
(45) Date of Patent: Jan. 9, 2001

(54) WALL PANEL MOUNTING SYSTEM AND METHOD

(75) Inventors: Angelo Zarrelli, Plainedge; Harvey C. Fein, New York; Charles A. Fein, Seaford, all of NY (US)

(73) Assignee: DFB Sales, Inc., Long Island City, NY (US)

( * ) Notice: Under 35 U.S.C. 154(b), the term of this patent shall be extended for 0 days.

(21) Appl. No.: 09/229,004

(22) Filed: Jan. 12, 1999

Related U.S. Application Data

(60) Provisional application No. 60/071,308, filed on Jan. 13, 1998.

(51) Int. Cl.[7] ..... E04B 1/38

(52) U.S. Cl. ..... 52/509; 52/235; 52/464; 52/481.2; 52/482; 52/656.9; 52/733.4; 52/774; 52/775

(58) Field of Search ..... 52/509–512, 460–464, 52/489.2, 481.2, 235, 731.2, 731.5, 773–777, 780, 762, 766, 482, 733.4, 597, 599, 656.1, 656.9; 403/295, 298, 401

(56) References Cited

U.S. PATENT DOCUMENTS

| | | | | |
|---|---|---|---|---|
| 2,182,523 | | 12/1939 | Markowski . | |
| 2,378,000 | | 6/1945 | Detrick . | |
| 2,607,971 | | 8/1952 | Bedford, Jr. . | |
| 3,387,418 | | 6/1968 | Tyrer . | |
| 4,259,767 | | 4/1981 | Holton . | |
| 4,449,346 | | 5/1984 | Tremblay . | |
| 4,665,662 | | 5/1987 | Swanborn . | |
| 5,094,051 | * | 3/1992 | Miller | 52/235 |
| 5,179,810 | | 1/1993 | Gename et al. . | |
| 5,579,624 | | 12/1996 | Aeberhard . | |
| 5,644,878 | * | 7/1997 | Wehrmann | 52/287.1 |
| 5,678,383 | * | 10/1997 | Danielewicz | 52/775 |
| 5,692,345 | * | 12/1997 | Mogaki et al. | 52/483.1 |
| 5,893,245 | * | 4/1999 | Sekiguchi et al. | 52/235 |

* cited by examiner

*Primary Examiner*—Carl D. Friedman
*Assistant Examiner*—Yvonne M. Horton
(74) *Attorney, Agent, or Firm*—Kramer Levin Naftalis & Frankel LLP

(57) ABSTRACT

A wall panel mounting system for releasably securing a preformed wall panel to a wall. The system includes a bracket including a base portion adapted to be attached to the wall and at least one leg extending outwardly from the base portion. The wall panel includes a frame having a front surface supporting a fabric thereon, with the frame including a rear wall having a recessed slot therein adapted to receive the at least one leg therein. The at least one leg and opposing walls defining the recessed slot have an interfering engagement to releasably hold the wall panel in place on the wall.

20 Claims, 4 Drawing Sheets

WALL PANEL MOUNTING SYSTEM AND METHOD

CROSS-REFERENCE TO RELATED PROVISIONAL APPLICATION

This application claims the benefit of U.S. Provisional Patent Application No. 60/071,308 filed on Jan. 13, 1998.

BACKGROUND OF THE INVENTION

The present invention is directed generally to a wall panel mounting system and method and, in particular, to a mounting system used to support preformed wall panels on a wall surface using a novel construction, system and method.

Various systems for covering walls are known. In addition to regular wallpaper applied with adhesive application, various types of fabric wall coverings are also known as wall fabrics and are directly adhered either to the wall surface or on brackets or clips applied to the wall. It is also known to provide upholstered wall panels which attach to the walls by various means such as screws, bolts or clips, for example, Z-clips. Typical wall panel systems are described, for example, in U.S. Pat. Nos. 4,449,346 to Tremblay, and 2,182,523 to Markowski.

While such wall panel systems provide a decorative and pleasing wall appearance, it has proven difficult to both attach the panels to the wall surface, and to remove the panels after installation for cleaning, replacement or the like. Accordingly, the present invention has been developed to improve over such prior art systems while allowing for neat fabrication, easy installation, and appropriate easy removal of the wall panels after installation.

SUMMARY OF THE INVENTION

Generally speaking, in accordance with the present invention, a wall panel mounting system for releasably securing a preformed wall panel to a wall, is provided. The system includes a bracket including a base portion adapted to be attached to the wall having at least one leg extending outwardly from the base portion. The wall panel includes a frame having a front surface supporting a fabric thereon. The frame includes a rear wall having a recessed slot therein adapted to receive the at least one leg therein. The recessed slot is defined by opposing walls. The at least one leg and opposing walls have an interfering engagement to releasably hold the wall panel in place on the wall.

In a preferred embodiment, the frame is rectangular and a suitable wall panel fabric is stretched therearound. The bracket is elongated and attached to the wall in a vertical direction, with the recessed slot in the frame extending in a vertical direction to mate with the at least one leg.

Accordingly, it is an object of the present invention to provide an improved wall panel mounting system and method.

Another object of the present invention is to provide a wall panel mounting system and method which allows easy installation and appropriate easy removal of the wall panels after installation.

A still further object of the present invention is to provide a wall panel mounting system and method which provides a neat and clean appearance to walls on which the system and method of the present invention are used to install wall panels.

Still other objects and advantages of the invention will in part be obvious and will in part be apparent from the specification.

The invention accordingly comprises the several steps and the relation of one or more of such steps with respect to each of the others, and the system embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Generally speaking, the present invention includes, as described in more detail below and depicted in the accompanying figures, a U-shaped fastener formed preferably from a thermoplastic material which is attached to a wall surface using an appropriate adhesive such as glue, or screws or other such fastening means. Each wall panel assembly includes a frame with slots which receive the legs of the U-shaped fastener to hold the wall panels on the wall.

Figure 1:
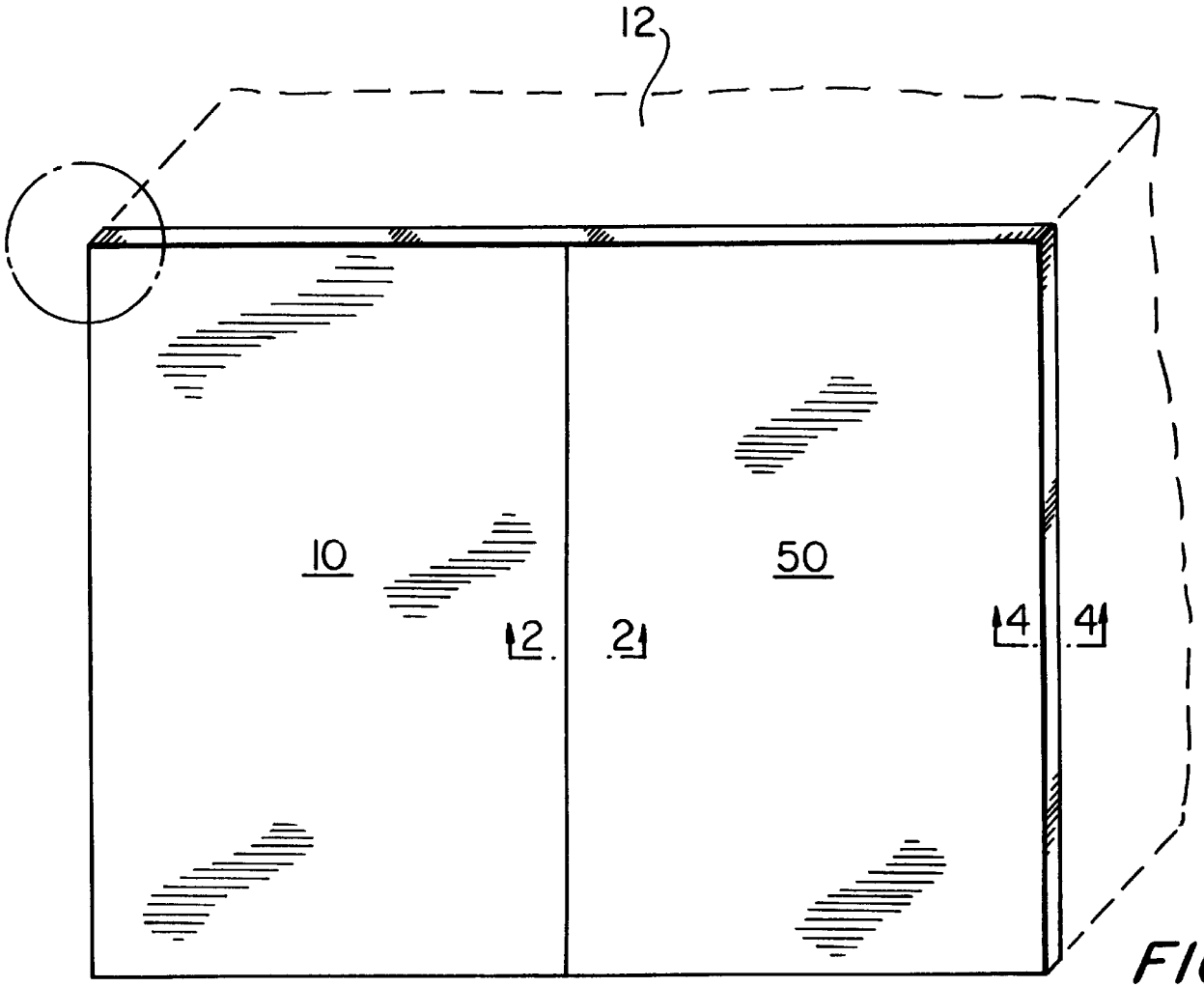
FIG. 1 is a perspective view of a wall showing adjacent wall panels mounted thereon using the system and method of the present invention.

FIG. 1 of the drawings depicts two wall panels 10 and 50 shown edge to edge supported on a wall 12. Looking more particularly at FIG. 2, it is noted that wall panels 10 and 50 are similarly constructed, so only wall panel 10 will be described in detail.

Wall panel 10 is formed from four lengths of an extruded aluminum material to form a frame 20. The four lengths of extruded aluminum of frame 20 are each an elongated strip of aluminum formed with the cross-section shown in FIG. 2. Frame 20 includes a front surface 22 having a raised flange or projection 24 on the outer edge thereof. Frame 20 also includes a side wall 26 and a rear wall 28. A generally square opening 30 is provided in frame 20 which is adapted to receive a panel rail connector 70 (FIG. 3) as will be described below in further detail.

An opposing wall 34 of frame 20 includes two extending fingers 36 and 38 which define a channel 37 for receiving a fill material 54 as will be described below. Frame 20 also includes a recessed slot 40 having opposing walls **40*a* and 40*b*** with a high friction surface or other attaching means such as serrations, grooves or the like therealong.

A U-shaped wall bracket 80 is preferably formed from a thermoplastic material and includes a base 82 having two upstanding legs 84 and 86. The opposing surfaces of legs 84 and 86 have a softer plastic or rubber-like material formed or applied thereon, preferably through co-extrusion or the like. Accordingly, the opposing surfaces of each of legs 84 and 86 will be strongly but releasably captured in slot 40.

Figure 3:
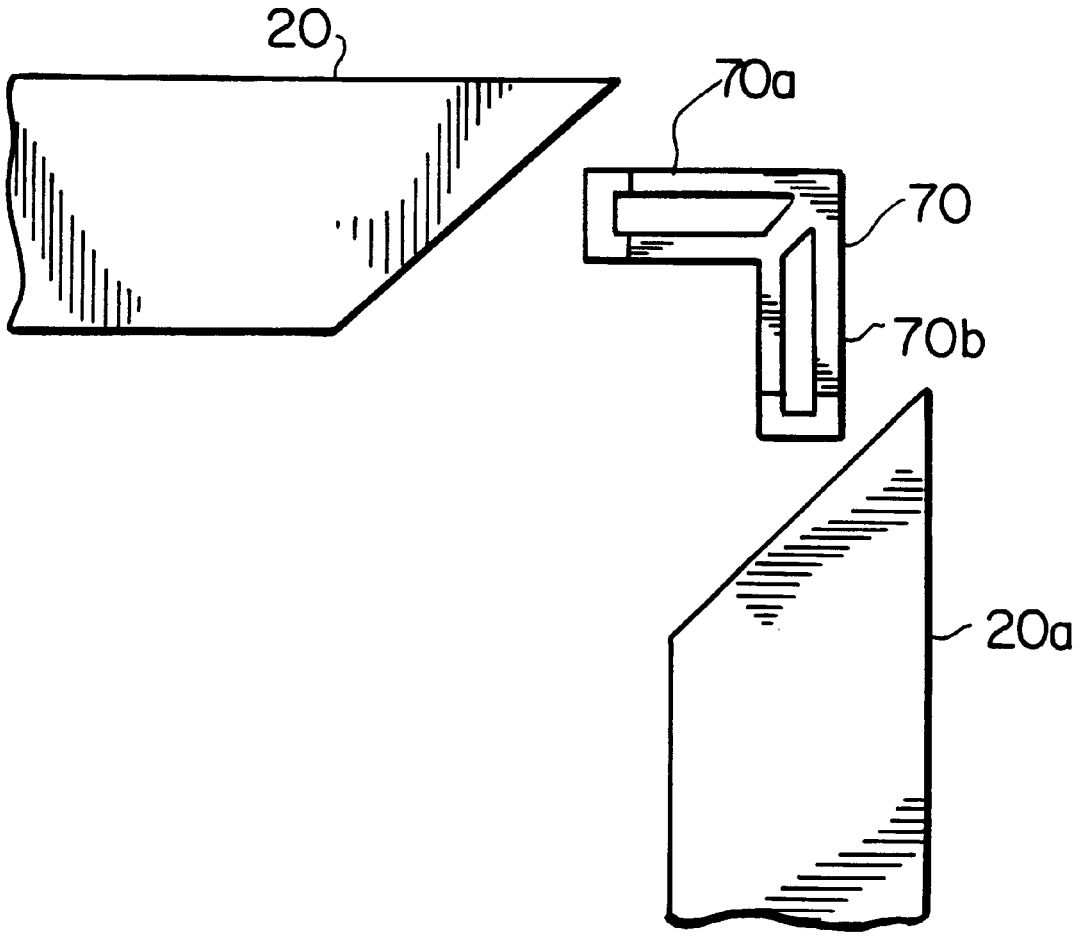
FIG. 3 is an enlarged sectional view taken along the sectional line 3 depicted in FIG. 1 showing the manner in which corners of the wall panel frame are joined together.

In order to form a full wall panel, such as rectangular wall panels 10 or 50 depicted in FIG. 1, four appropriate lengths (two vertical and two horizontal) of extruded aluminum to form frame 20 are provided. Each end of each of the four frame sections are cut at a 45° angle to allow the frame pieces to be joined edge to edge to form a rectangular frame, much like the edges of a picture frame are joined. The L-shaped panel rail connector 70 shown in FIG. 3 is used to join adjacent frame sections 20 and 20*a* together. Legs 70*a* and 70*b* of panel rail connector 70 are received respectively in a corresponding opening 30 in adjacent frame sections 20 and 20*a*. The corners of frames 20 and 20*a* can then be staked to hold the frame edges together.

Because panel rail connector 70 and opening 30 are generally square in cross-section, the panel rail connector can be inserted in various orientations to allow for inside and outside comers, irregular surfaces and shapes, and the like.

Frame 20 is preferably formed around a relatively rigid fill material 54 such as duct board with a foil backing 55 which is properly cut to size. Fill material 54 can also form a tackable surface such as the Micore® product from U.S. Gypsum (non-hydroscopic), or wood or wood grounds can be placed in strategic locations on the panels to allow pictures or the like to be supported on the wall panels. Alternatively, the fill can be customized for particular client needs involving acoustics, hanging of various items, or the like. It is preferred that the fill material be essentially impervious to air transmission to prevent air from circulating through the panels to dirty or soil the fabric.

After the four frame sections are joined together using the panel rail connectors 70 and fill material is encased thereby, a desired fabric or other material 60 is glued or otherwise adhered thereon in the manner indicated by stretching over the front surface 22 of frame 20, along the side 26 and partially around the back 28 using glue, other adhesive or the like to hold the fabric thereon. Flange or projection 24 raises fabric 60 off of the surface of fill material 54 and front surface 22 of bracket 20 to give a neat, clean appearance and to hide imperfections. Any type of fabric or other material suitable for wall coverings may be used. As used herein, fabric refers to any suitable material supported on the front surface of the frame.

Figure 4:
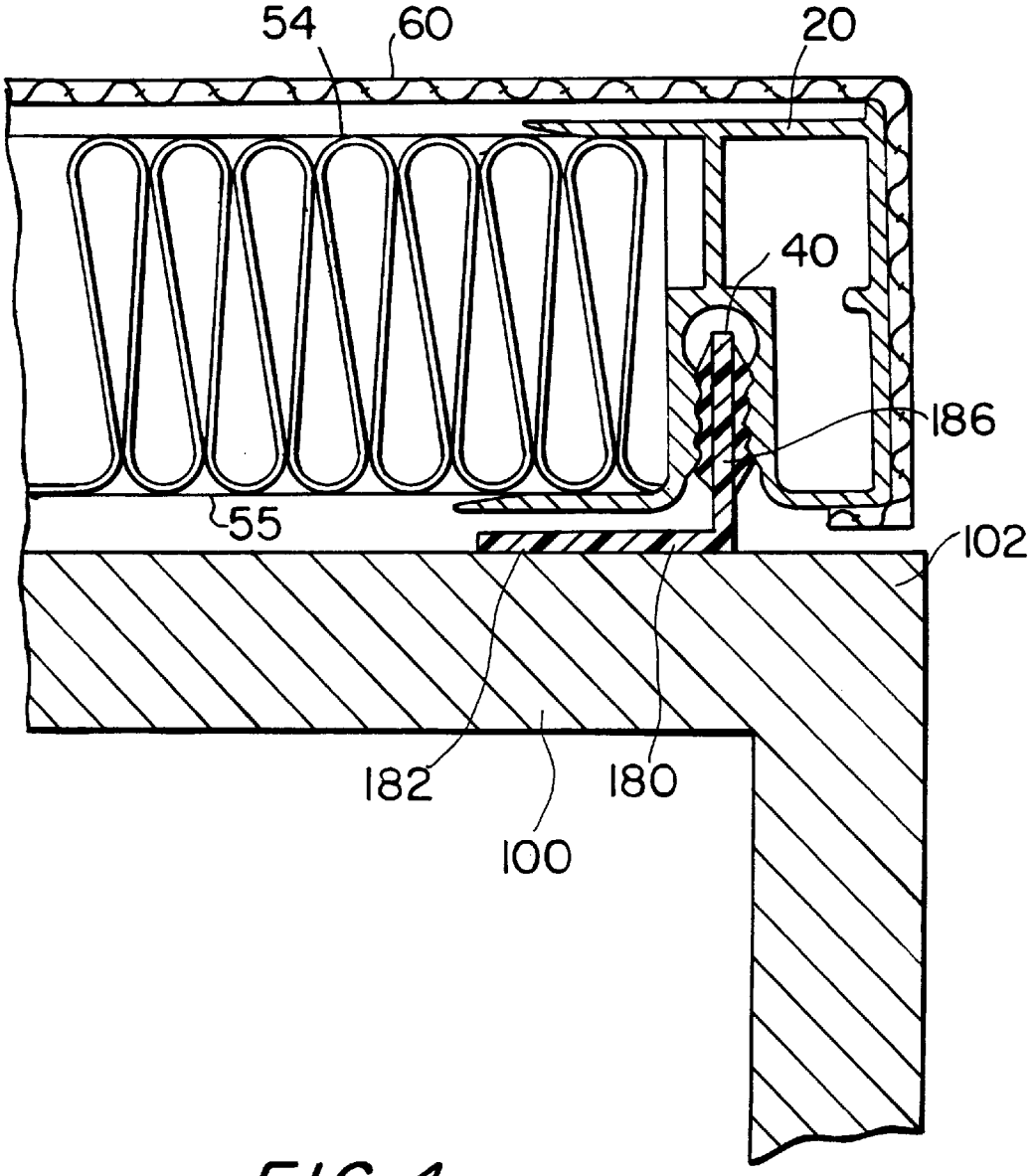
FIG. 4 is an enlarged sectional view taken along line 4—4 of FIG. 1.

Installation of the wall panels usually starts at the edge of the wall, either at an inside or outside corner or edge. FIG. 4 of the drawings shows such an outside corner installation, for example. Starting at the edge 102 of wall 100, one leg 186 of a bracket 180 is utilized. In this regard, U-shaped plastic bracket 80 can be pre-scored along the backwall thereof to allow the component to be broken into two separate L-shaped components when desired for use, for example, as depicted in FIG. 4.

Leg 182 of bracket 180 is secured to wall 100 using appropriate fastening means such as an adhesive, glue, screws or the like. Bracket 180 is supported on wall 100 in a vertical fashion so that the panel (10 or 50) can be properly adjusted vertically with respect to the ceiling and floor. Horizontal brackets are not needed or desirable. Slot 40 of frame 20 is positioned over leg 186 and is then pressed thereon. Serrations on the inside walls forming slot 40 interfere with serrations formed on leg 186 to interlock the panel thereon to hold the panel in the desired orientation and alignment on the wall.

Figure 2:
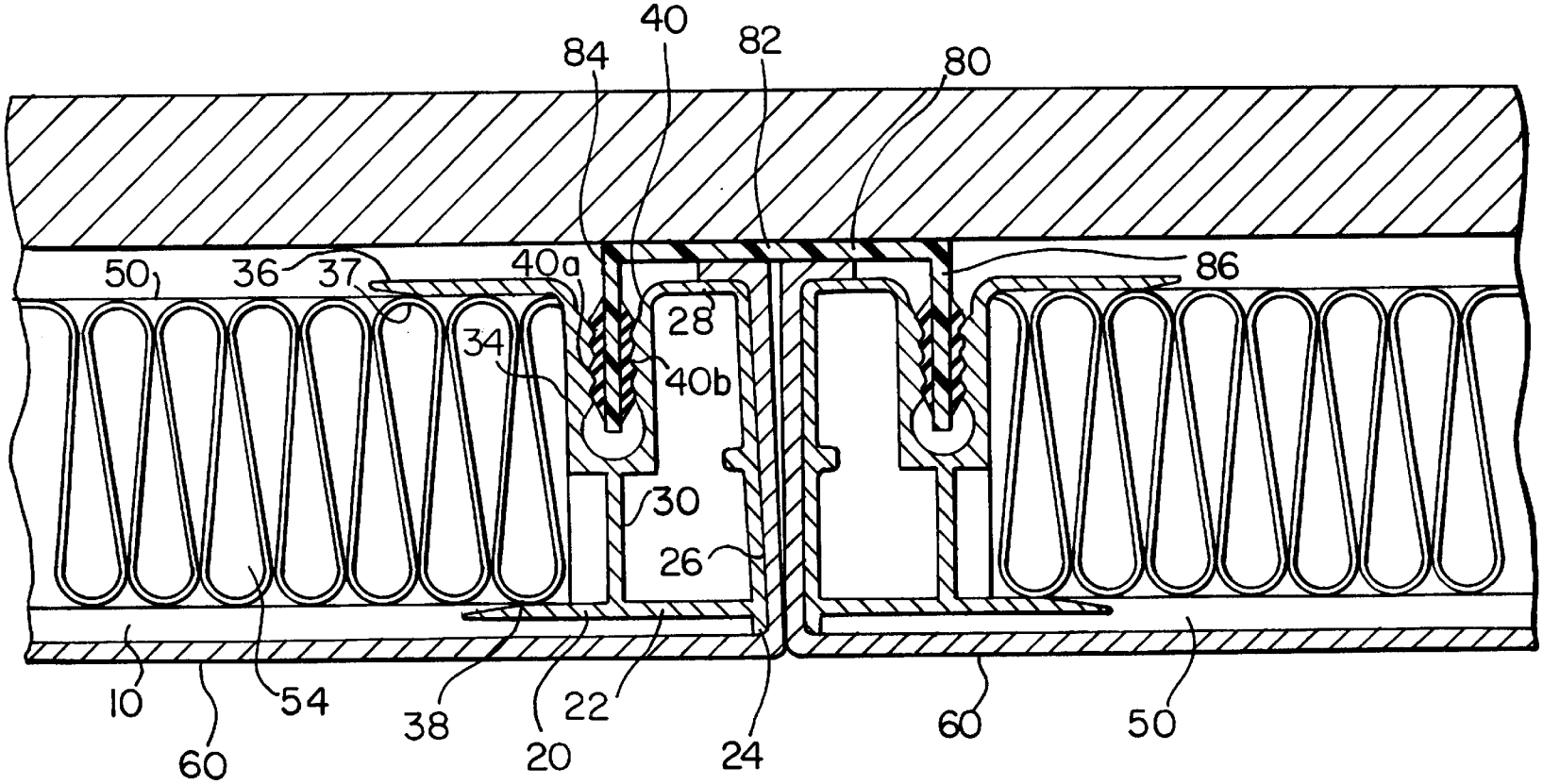
FIG. 2 is an enlarged sectional view taken along line 2—2 of FIG. 1.

Next, a U-shaped bracket 80 is supported vertically on the wall in alignment with the vertical slot on the other side of the wall panel, and the second leg of the U-shaped bracket can be used to hold one edge of the next panel tightly adjacent thereto as best depicted in FIG. 2. In this regard, it is noted that side wall 26 of each frame section includes about a 1° to 1 ½° relief to cause the outer edges of the panels to abut against one another as depicted. This feature is also provided to allow for imperfections on the wall surface or for manufacturing tolerances.

Installation continues as described above until the entire wall surface or room is appropriately covered with wall panels. The system, construction and method of the present invention allows for quick and efficient field installation.

While the combined bracket and panel system of the present invention provides a tight hold of the panels to the wall, the system also allows removal of the panels for any desired reason or purpose. The top or bottom of the panel can be appropriately grabbed by hand or a pry tool used to pull the panel away from the wall thereby releasing the interfering serrations or other gripping means of the bracket legs and slot walls. In this fashion, panels can be replaced, repaired, cleaned or the like.

It is noted that the serrations in the slot should preferably not match the serrations on the bracket. Thus, for example, in slot 40, there might be six (6) serrations per inch, while on bracket leg 84 there might be five (5) serrations per inch. The bracket itself is preferably co-extruded from plastic material having two different durometers. The base portion of the bracket is preferably formed from hard plastic material such as PVC having a durometer of 100, whereas the opposing inner and outer surfaces of the legs of the U-shaped bracket are co-extruded with a PVC material having a durometer of 75 to 80 for example. The plastic formation of the bracket gives it the rigid flexibility and resiliency to help abut the front edges of adjacent panels together.

The corner braces or rail panel connectors 70 are preferably formed of a high tension polymer such as ABS.

The present construction, using, for example, a fill with foil backing, essentially prevents air from flowing through the panels, thereby cutting down on dirt or dust flow therethrough. In addition, because the bracket covers air flow through the seams between panels, an essentially total barrier is provided.

The detailed description herein is not meant to be limited to the specific embodiments or figures described. There are many appropriate variations that will accomplish the intent of the invention and be within the spirit and scope of the invention as will be recognized by those skilled in the art.

It will thus be seen that the objects set forth above, among those made apparent from the preceding description, are efficiently attained and, since certain changes may be made in carrying out the above method and in the system set forth without departing from the spirit and scope of the invention, it is intended that all matter contained in the above description and shown in the accompanying drawings shall be interpreted as illustrative and not in a limiting sense It is also to be understood that the following claims are intended to cover all of the generic and specific features of the invention herein described and all statements of the scope of the invention which, as a matter of language, might be said to fall therebetween.

What is claimed is:

1. A wall panel mounting system for releasably securing a preformed wall panel to a wall, the system comprising at least one panel and a bracket formed from a thermoplastic material having two different durometers, said bracket including a base portion adapted to be attached to said wall and at least one leg extending outwardly from said base portion, said wall panel including a frame having a front surface supporting a fabric, said frame including a rear wall having a recessed slot therein adapted to receive said at least one leg therein, said recessed slot being defined by opposing walls, said at least one leg and opposing walls defining said recessed slot having an interfering engagement to releasably hold said wall panel in place on said wall.

2. The wall panel mounting system as claimed in claim 1, wherein said at least one leg on said bracket includes a surface having a first durometer plastic material and said base portion is formed from a different durometer plastic material.

3. The wall panel mounting system as claimed in claim 1, wherein said bracket is co-extruded from plastic material having two different durometers.

4. The wall panel mounting system as claimed in claim 2, wherein said first durometer plastic material is formed with serrations.

5. The wall panel mounting system as claimed in claim 1, wherein at least one of said opposing walls of said recessed slot includes a high friction surface.

6. The wall panel mounting system as claimed in claim 1, wherein at least one of said opposing walls defining said recessed slot includes serrations.

7. The wall panel mounting system as claimed in claim 4, wherein one of said opposing walls defining said recessed slot includes serrations thereon which do not match the serrations of said first durometer plastic material.

8. The wall panel mounting system as in claim 1, wherein said bracket includes a second leg extending outwardly from said base portion, said second leg securing a second wall panel to abut against said first wall panel.

9. The wall panel mounting system as claimed in claim 1, wherein said bracket is elongated and attachable to said wall in a vertical direction, said recessed slot in said frame extending in a vertical direction to mate with said at least one leg.

10. The wall panel mounting system as in claim 1, wherein said front surface includes a raised flange along an outer edge thereof for raising said fabric off said front surface.

11. The wall panel mounting system as in claim 8, wherein said frame includes a side wall, said side wall having a relief.

12. A wall panel mounting system for releasably securing a preformed wall panel to a wall, the system comprising at least one wall panel and a bracket, said bracket including a base portion adapted to be attached to said wall and at least one leg extending outwardly from said base portion, said wall panel including a frame having a front surface supporting a fabric, said frame including frame sections joined together at edges thereof by panel rail connectors, said panel rail connectors having legs shaped to be received in corresponding openings in adjacent frame sections, said frame also including a rear wall having a recessed slot therein adapted to receive said at least one leg therein, said recessed slot being defined by opposing walls, said at least one leg and opposing walls defining said recessed slot having an interfering engagement to releasably hold said wall panel in place on said wall.

13. The wall panel mounting system as in claim 12, wherein said frame sections are formed from extruded aluminum.

14. The wall panel mounting system as in claim 13, wherein said preformed wall panel includes fill material held within said frame by said frame sections.

15. The wall panel mounting system as in claim 14, wherein said fill material includes a backing material.

16. A method for releasably securing preformed first and second wall panels to a wall comprising the steps of:

attaching an elongated bracket base portion to a wall, said base portion having first and second spaced bracket legs extending outwardly therefrom, said base portion being prescored to permit separation of said base into two sections each having a bracket leg thereon, said first and second wall panels each including a frame having a first vertical frame section having a recessed slot defined therein between opposing slot walls adapted to grippingly receive one of said first and second bracket legs;

pressing said first wall panel against said wall bracket so that said first bracket leg is captured within said recessed slot in said first vertical frame section; and pressing said second wall panel against said second wall bracket such that said second bracket leg is captured within said recessed slot in said first vertical frame section of said second wall panel, said first wall panel thereby abutting against said second wall panel.

17. A wall panel mounting system for releasably securing preformed wall panels to a wall, the system comprising at least one wall panel and at least one unitary bracket including a base portion adapted to be attached to said wall and integral first and second spaced bracket legs extending outwardly from said base portion, first and second wall panels each including a frame having a front surface supporting a fabric, each said frame including a rear wall having a recessed slot therein defined by opposing walls arranged and constructed to interferingly engage either one of said first and second bracket legs to releasably hold said first and second wall panels in place on said wall, whereby said first and second wall panels abut against each other when in engagement with said bracket.

18. The wall panel mounting system as claimed in claim 17, wherein said bracket is formed from a thermoplastic material having two different durometers.

19. The wall panel mounting system as claimed in claim 17, wherein said frame of each of said first and second wall panels includes frame sections joined together at edges thereof by panel rail connectors, said panel rail connectors having legs shaped to be received in corresponding openings in adjacent frame sections.

20. The wall panel mounting system as claimed in claim 17, wherein said frame of each of said first and second wall panels includes a side wall having a relief.

* * * * *